US005691604A

United States Patent [19]

Viljanen

[11] Patent Number: 5,691,604

[45] Date of Patent: Nov. 25, 1997

[54] METHOD AND CIRCUIT SYSTEM FOR CONTROLLING A LIGHTING ELECTRONICS APPLIANCE

[75] Inventor: Teijo Viljanen, Kauniainon, Finland

[73] Assignee: Oy Helvar, Finland

[21] Appl. No.: 559,771

[22] Filed: Nov. 15, 1995

[30] Foreign Application Priority Data

Nov. 24, 1994 [FI] Finland ..... 945515

[51] Int. Cl.[6] ..... H05B 37/02; G05F 1/00

[52] U.S. Cl. ..... 315/291; 315/307; 327/18; 340/310.02; 340/825.57

[58] Field of Search ..... 307/128, 125, 307/129, 106; 315/291, 307, DIG. 4; 327/78, 79, 89, 18, 31, 39, 44, 50, 37, 74, 76; 329/317; 340/310.02, 310.06, 825.57, 825.63

[56] References Cited

U.S. PATENT DOCUMENTS

| | | | |
|---|---|---|---|
| 5,204,587 | 4/1993 | Mortimer et al. | 315/308 |
| 5,339,009 | 8/1994 | Lai | 315/291 |

FOREIGN PATENT DOCUMENTS

| | | |
|---|---|---|
| 0490330B1 | 12/1991 | European Pat. Off. . |
| 0 622 978 A1 | 2/1994 | European Pat. Off. . |
| 74828 | 9/1986 | Finland . |
| 915757 | 12/1991 | Finland . |
| 2194862B | 3/1988 | United Kingdom . |

*Primary Examiner*—Robert Pascal
*Assistant Examiner*—Arnold Kinkead
*Attorney, Agent, or Firm*—Zarley, McKee, Thomte, Voorhees, & Sease

[57] ABSTRACT

The invention relates to a method and a circuit system for controlling an appliance used in lighting electronics, especially an electronic ballast or an electronic light controller included in a discharge lamp. An analog or digital type of signal for controlling the operation of an appliance to be controlled is connectable to a common control circuit and. The appliance to be controlled identifies the type of control signal and deciphers the contents of information received thereby on the basis of the signal type.

12 Claims, 1 Drawing Sheet

METHOD AND CIRCUIT SYSTEM FOR CONTROLLING A LIGHTING ELECTRONICS APPLIANCE

BACKGROUND OF THE INVENTION

1. Field of the Invention

The present invention relates to a method, whereby a lumino-technical electronic appliance, particularly the electronic ballast or light controller of a discharge lamp, can be controlled by means of an analog and digital signal over a common control line, as well as to a circuit system for implementing said method.

2. Problems In the Art

In controllable electronic ballasts or light controllers, the light level produced by a lamp connected to the appliance has been traditionally controlled by using an analog control circuit, the control signal generally comprising a direct voltage and the lamp-generated light level being proportional to the strength of the control voltage. In addition, This type of analog control has made it possible to switch an appliance on and off without a separate mains switch. Naturally, such a control method is limited by the restrictions of achievable control measures and on the other hand by the lack of a general control standard, which makes it more difficult to connect various types of appliances to each other.

There are also previously proposed digital control solutions which provide considerably more versatile control possibilities. The international performance standard IEC 929 for electronic ballasts has been prepared to include a supplement for determining the voltage level of an analog control to be a direct voltage of 1–10 V as well as a digital control by using a pulse-width modulated signal (proposal document IEC 34C (CO) 276). Digital control solutions for electronic ballasts have also been described in Patent application FI 915757, wherein the brightness and other operating characteristics of a discharge lamp are controlled by means of a path. Analog control solutions for electronic ballasts have been described e.g. in Patent publication FI 74828. The cited solutions as well as other prior known applications are based on providing the appliance with separate control terminals for digital and analog control modes. The same applies typically also to electronic systems other than appliances used in lighting electronics.

A drawback in the prior known solutions is that the separation of digital and analog control modes into separate terminals adds to the manufacturing costs of an appliance to be controlled, in case it is to have a versatile application with a variety of control devices. The configuration of separate terminals will be particularly expensive in cases when the terminals must be separated from operating-voltage terminals for securing a sufficient voltage strength. This is a typical situation in appliances used in lighting electronics, wherein the control terminals must be designed in a so-called double-insulated form for reasons of safety. In addition, the separate control terminals add to the cable-laying costs and complicate modifications subsequently made to the assembly, since an analog control device cannot be replaced by a digital one, if a digital control terminal has been excluded from an appliance to be controlled for cost-cutting reasons. Another result from separate control terminals is that the equipment manufacturers are forced to include a more extensive variety of products in their manufacturing program for satisfying the demands of customers.

SUMMARY OF THE INVENTION

An object of this invention is to eliminate the above drawbacks by providing a digital and an analog control over a common control terminal. A method of the invention is characterized in that information in the digital or analog mode is transferable over a common terminal to an appliance to be controlled, wherein the signal is deciphered to be analog or digital.

A benefit offered by the solution of the invention is the simplification of a system consisting of a control device and an appliance to be controlled, as the same control terminal is capable of accepting both analog and digital signals and information. The same appliance used in lighting electronics can be put to more diversified application by selecting for the system an analog or a digital control device on the basis of given temporary system requirements and the actual appliance to be controlled is in all cases the same product. Thus, a given variety of products can be used for covering a higher number of various customer demands. With certain restrictions, a common control path can be used for connecting therewith simultaneously each type of control devices.

DETAILED DESCRIPTION OF PREFERRED EMBODIMENT

Figure 1:
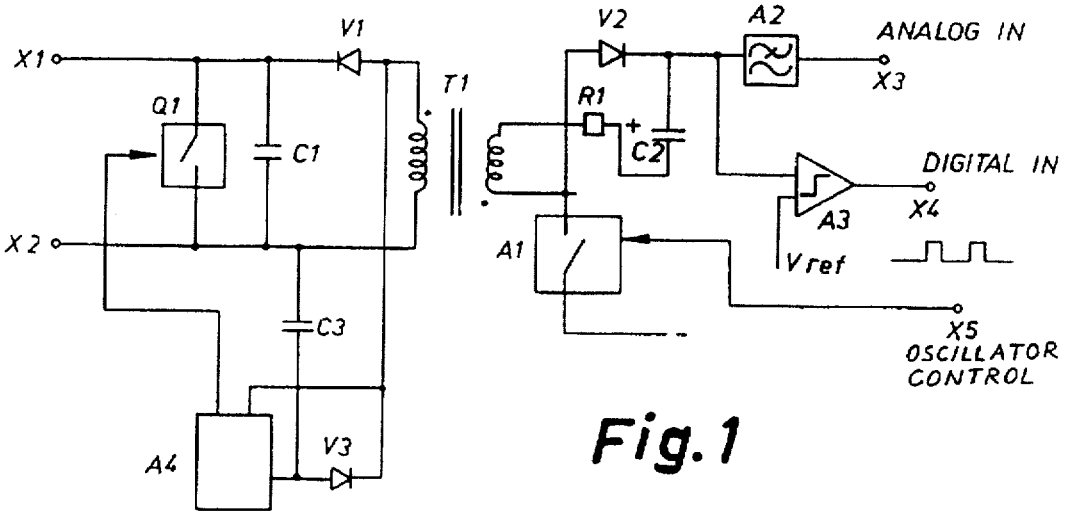
FIG. 1 is a simplified electrical schematic diagram depicting a circuit system according to the present invention.

The assembly shown in FIG. 1 is primarily included in a ballast or a light controller to be controlled but of course there is nothing to prevent its design even as a separate fitting unit. Analog or digital control signal is connected to terminals X1–X2. In terms of its operation, the circuit is a so-called set-value oscillator, wherein a control voltage is used between the terminals X1–X2 for cutting off voltage peaks produced by an oscillator A1. Thus, the cutting level of voltage peaks appears as a voltage across a capacitor C2. In case the control signal is analog, i.e. a slowly changing direct voltage, a low pass filter A2 is capable of producing an equal voltage in a terminal X3. In case of a digital control, The control pulses can be reconstructed in a terminal X4 by means of a comparator A3 in which is set an appropriate reference voltage Vref. A transformer T1 is used for attaining a potential difference between input and output blocks of the circuit. The oscillator A1 can be an independent oscillator whose operation is controlled by a signal in a terminal X5 or the oscillator can also be replaced by an electronic switch element whose pulsing is effected by a clock signal received e.g. from a micro-computer. From the terminals X3 and X4 the signal is carried to a logical control unit for deciphering the information received thereby.

Figure 3:
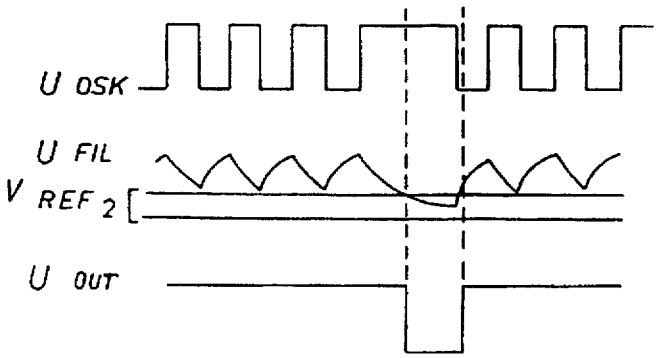
FIG. 3 is a graphical representation of the waveforms and voltages resulting from the present invention.

The circuit operates in the other way such that a pulse absence detector A4 reconstructs the waveform by controlling a switch Q1. The block A4 can be for example a series connection including a low pass filter and a comparator, wherein the low pass filter has a time constant which is appropriately selected relative to the pulse frequency and in the comparator is set a reference voltage level Vref2 which is preferable over the signal amplitude. The operation is disclosed in FIG. 3, wherein a waveform Uosk is the voltage waveform on the oscillator A1, Ufil is a voltage after the low pass filter in one terminal of the comparator, and Vref2 is a reference voltage in the other terminal of the comparator and Uout is the waveform in the output of detector A4.

Figure 2:
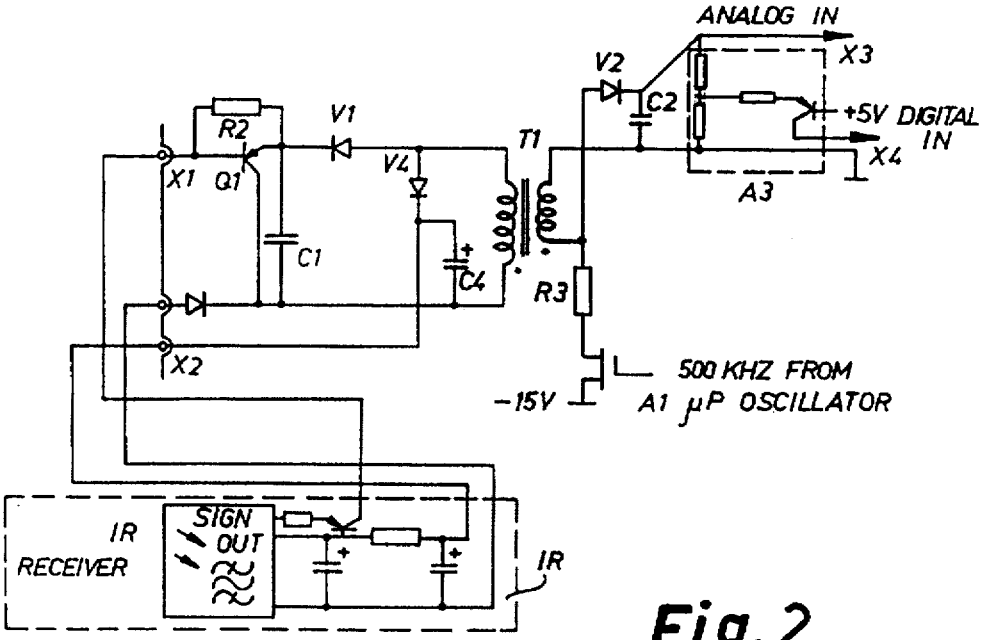
FIG. 2 is a more detailed electrical schematic diagram of the method and circuit system of FIG. 1.

The drawing FIG. 2 illustrates in detail one way of implementing the solution of FIG. 1. In this example, to the control terminals X1, X2 is connected a digital control unit or an infrared control system receiver IR. The illustrated circuit system is suitable to be connected as such for example to an electronic light controller. The corresponding components are designated by the same reference symbols as in FIG. 1. In addition, there is provided an operating-voltage supply to the IR receiver circuit over a transformer T1 and a diode V4 by means of a chargeable capacitor C4.

The input current is set by means of a resistance R2. The maximum current from an oscillator A1 is limited by a resistance R3. Otherwise the operation corresponds to what is described in reference to FIG. 1.

Although the invention has been described above with reference to the examples shown in the accompanying drawings, it is obvious that the invention is not limited to those only but can be varied in may ways within the scope of the above specification as well as the inventional concept set forth in the annexed claims. A principle according to the invention is not restricted only to be applied in ballasts for low-pressure discharge lamps but it is just as well applicable to ballasts of other types of discharge lamps, to electronic light controllers and even to other products used in lighting electronics. The solutions is particularly useful in appliances, wherein the logical control is carried out by a micro-computer or a similar element. In this case, the circuit design is quite simple since the control signals in the terminals X3 and X4 of FIG. 1 are almost as such connectable to a micro-computer which can also carry out the oscillator operation, as shown in FIG. 2.

I claim:

1. A method for controlling an appliance used in lighting electronics, especially an electronic ballast or an electronic light controller included in a discharge lamp, comprising: connecting an analog or digital type of signal foe controlling the operating status of an appliance to be controlled to a common control circuit and the appliance to be controlled, identifying the type of control signal, and deciphering the type of control signal and deciphering the contents of information in the analog or digital control signal received thereby on the basis of the signal type, including a circuit for separating the digital and analog information in the analog or digital control signal from each other, a logical element for deciphering the digital or analog information and an oscillator comprising an electronic switch element which is controlled by the logical element.

2. A circuit system for controlling an appliance used in lighting electronics, especially an electronic ballast or an electronic light controller, including a discharge lamp, comprising: an oscillator which produces a signal and includes an electronic switch element which is controlled by a logical element, whereby a digital or analog control signal containing digital or analog information for controlling the operating status of an appliance to be controlled is carried via a separation transformer to a unit for separating the digital and analog information from each other.

3. A method as set forth in claim 1 characterized in that the circuit system includes a low pass filter for separating an analog control signal from a digital one.

4. A method as set forth in claim 1 characterized in that the circuit system includes a comparator for separating a digital control signal from an analog one by comparing an incoming signal voltage with a reference voltage.

5. A circuit system as set forth in claim 1, characterized in that the circuit system includes a pulse-absence detecting circuit and between control signal terminals an electronic switch element for controlling the detecting circuit.

6. A circuit system as set forth in claim 2, characterized in that the circuit system includes a low pass filter for separating an analog control signal from a digital one.

7. A circuit system as set forth in claim 2, characterized in that the circuit system includes a comparator for separating a digital control signal from an analog one by comparing an incoming signal voltage with a reference voltage.

8. A circuit system as set forth in claim 3, characterized in that the circuit system includes a comparator for separating a digital control signal from an analog one by comparing an incoming signal voltage with a reference voltage.

9. A circuit system as set forth in claim 2 characterized in that the circuit system includes a programmable logical element for deciphering the control information.

10. A circuit system as set forth in claim 3 characterized in that the circuit system includes a programmable logical element for deciphering the control information.

11. A circuit system as set forth in claim 4 characterized in that the circuit system includes a programmable logical element for deciphering the control information.

12. A circuit system for controlling an appliance used in lighting electronics, especially an electronic ballast or an electronic light controller included in a discharge lamp, comprising:

a circuit for separating digital and analog information from each other;

a logical element for deciphering the information;

an oscillator comprising an electronic switch element which is controlled by the logical element;

wherein an analog or digital type of control signal containing analog or digital information for controlling the operating status of an appliance to be controlled is connectable to a common control circuit, and the appliance to be controlled identifies the type of control signal and deciphers the contents of the information received thereby on the basis of the control signal type.

* * * * *

UNITED STATES PATENT AND TRADEMARK OFFICE

CERTIFICATE OF CORRECTION

PATENT NO. : 5,691,604
DATED : November 25, 1997
INVENTOR(S) : Teijo Viljanen

It is certified that error appears in the above-identified patent and that said Letters Patent is hereby corrected as shown below:

In claim 1, column 3, line 36, please delete [foe] and substitute --for--.

Signed and Sealed this

Third Day of February, 1998

*Attest:*

Bruce Lehman

BRUCE LEHMAN

*Attesting Officer*

*Commissioner of Patents and Trademarks*